US005692487A

United States Patent [19]

Schuerz et al.

[11] Patent Number: 5,692,487

[45] Date of Patent: Dec. 2, 1997

[54] METHOD FOR PARAMETRIZING A LINEAR LAMBDA CONTROLLER FOR AN INTERNAL COMBUSTION ENGINE

[75] Inventors: Willibald Schuerz, Aufhausen; Florian Tisch, Regensburg, both of Germany

[73] Assignee: Siemens Aktiengesellschaft, Munich, Germany

[21] Appl. No.: 647,463

[22] Filed: May 3, 1996

[30] Foreign Application Priority Data

May 3, 1995 [DE] Germany ..... 195 16 239.0

[51] Int. Cl.[6] ..... F02D 41/00; F02M 23/00; F02M 25/00

[52] U.S. Cl. ..... 123/696

[58] Field of Search ..... 123/696, 694, 123/687, 695, 492, 493, 674; 60/276; 364/424.1

[56] References Cited

U.S. PATENT DOCUMENTS

| | | | |
|---|---|---|---|
| 4,741,311 | 5/1988 | Nakajima et al. | 123/696 |
| 5,220,905 | 6/1993 | Lundahl | 123/696 |
| 5,253,632 | 10/1993 | Brooks | 123/696 |
| 5,263,464 | 11/1993 | Yoshida et al. | 123/674 |
| 5,363,831 | 11/1994 | Tomisawa et al. | 123/695 |
| 5,438,827 | 8/1995 | Ohuchi et al. | 60/276 |
| 5,503,134 | 4/1996 | Delosh | 123/687 |

FOREIGN PATENT DOCUMENTS

93/24747 12/1993 WIPO .

OTHER PUBLICATIONS

Automobili-Industrie, (1987), No. 6, pp. 629–636: "Regelverfahren in der elekronischen Motorsteuerung—Teil 1 (Control processor in the electronic engine control—Part 1)" (Kiencke et al. ).

*Primary Examiner*—Raymond A. Nelli

*Attorney, Agent, or Firm*—Herbert L. Lerner; Laurence A. Greenberg

[57] ABSTRACT

A method for parametrizing a lambda controller of a lambda control device having a lambda sensor supplying an output signal at least partially exhibiting a linear dependency on an oxygen content in exhaust gas of an internal combustion engine, includes representing a transfer function of a lambda controlled system by a series connection of first and second first order delay elements and an idle time element in a lambda control loop. The first delay element contains a response behavior of the lambda sensor and the second delay element contains a sliding averaging of measured lambda values.

8 Claims, 2 Drawing Sheets

METHOD FOR PARAMETRIZING A LINEAR LAMBDA CONTROLLER FOR AN INTERNAL COMBUSTION ENGINE

BACKGROUND OF THE INVENTION

1. Field of the Invention

The invention relates to a method for parametrizing a linear lambda controller for an internal combustion engine, having a lambda sensor with an output signal at least partially exhibiting a linear dependency on an oxygen content in exhaust gas of the internal combustion engine.

At present, lambda control in conjunction with a three-way catalytic converter represents the most effective method for cleaning exhaust gas in internal combustion engines. An oxygen sensor, which as a rule is called a lambda sensor, that is located upstream of the catalytic converter, furnishes a signal which is dependent on the oxygen content in the exhaust gas. The lambda controller further processes this signal in such a way that the fuel-air mixture being supplied through the use of a metering device such as injection valves or a carburetor to the engine cylinders, enables virtually complete combustion ($\lambda$=1.00).

So-called skip or discontinuity sensors, having an output signal which changes abruptly both at the transition from a rich to a lean exhaust gas state and at the transition from a lean to a rich exhaust gas state, are used as lambda sensors. Such lambda sensors based on zirconium oxide or titanium oxide have response times of about 100 ms and therefore detect the oxygen content in the overall exhaust gas, which is composed of the individual batches of exhaust gas from the various engine cylinders. In order to provide lambda control, a two-point proportional-integral control algorithm is typically used. The choice of optimal controller parameters for achieving a limit cycle of defined amplitude and frequency is made by time-consuming application on the engine test bench.

In order to provide mixture control in an internal combustion engine, it is known to provide an oxygen sensor that has a linear dependency of its output signal on the air number $\lambda$ and moreover has a short response time. (SAE Paper 940149, "Automatic Control of Cylinder by Cylinder Air-Fuel Mixture Using a Proportional Exhaust Gas Sensor" and SAE Paper 940376, "Individual Cylinder Air-Fuel Ratio Feedback Control Using an Observer".)

Such linear lambda sensors are constructed on the basis of strontium titanate ($SrTiO_3$), for instance, with thin film technology (VDI Berichte [Reports of the Association of German Engineers] 939, Düsseldorf 1992, "Vergleich der Ansprechgeschwindigkeit von KFZ Abgassensoren zur schnellen Lambdamessung auf der Grundlage yon ausgew ählten Metalloxiddünnfilmen" ["Comparison of the Response Speed of Motor Vehicle Exhaust Gas Sensors for Rapid Lambda Measurement on the Basis of Selected Metal Oxide Thin Films"]).

The use of linear lambda sensors leads to a shift from two-point lambda control to linear lambda control. If a proportional, integral and differential (PID) control algorithm is chosen as the linear lambda controller, then the number of parameters becomes so great that they can no longer be optimized within a reasonable amount of time.

2. Summary of the Invention

It is accordingly an object of the invention to provide a method for parametrizing a linear lambda controller for an internal combustion engine, which overcomes the hereinafore-mentioned disadvantages of the heretofore-known methods of this general type and with which the number of variables to be applied can be reduced, given optimal setting or adjustment.

With the foregoing and other objects in view there is provided, in accordance with the invention, a method for parametrizing a lambda controller of a lambda control device having a lambda sensor supplying an output signal (ULS) at least partially exhibiting a linear dependency on an oxygen content in exhaust gas of an internal combustion engine, which comprises representing a transfer function of a lambda controlled system ($G_S$) by a series connection of first and second first order delay elements and an idle time element in a lambda control loop, wherein the first delay element contains a response behavior of the lambda sensor, and the second delay element contains a sliding averaging of measured lambda values.

In accordance with another mode of the invention, there is provided a method which comprises selecting a proportional-integral-differential (PID) controller as the lambda controller, and determining P, I and D controller components of the controller according to:

$$KP=T_SONDE+T_GMW+TA/2)\cdot K$$

$$K1=TA\cdot K$$

$$KD=(T_SONDE\cdot T_GMW\cdot 1/TA)\cdot K$$

where T_SONDE is a time constant for the response performance of the lambda sensor, T_GMW is a time constant for sliding averaging, T_TOTZ is an idle time in the lambda control loop, TA is a sampling time, and K is a factor (as a function of the idle time).

In accordance with a further mode of the invention, there is provided a method which comprises selecting a proportional-integral (PI) controller as the lambda controller, and calculating P and I controller components of the controller as a function of a mean lambda value (LAMMW_IST) and a command value (LAM_SOLL).

In accordance with an added mode of the invention, there is provided a method which comprises determining the proportional controller component as LAM_P_(n)=LAM_KPI_FAK(n)·P_FAK_LAM·(T_LS+TA)·LAM_DIF(n), and determining the integral controller component as LAM_I(n)=LAM_I(n−1)+LAM_KPI_FAK(n)·I_FAK_LAM·2·TA·LAM_DIF(n), where LAM_KPI_FAK=control amplification factor, P_FAK_LAM=applicable constant, I_FAK_LAM=applicable constant, T_LS=applicable time constant (in seconds), TA=segment duration (in seconds), n=number of the measured value, and LAM_DIF(n)=control deviation.

In accordance with an additional mode of the invention, there is provided a method which comprises sampling the sensor signal (ULS1) multiple times per cycle of the engine; ascertaining an associated lambda actual value (LAM_IST (n)) from a characteristic curve for each value of the sensor signal (ULS1, ULS2); forming a mean lambda value (LAMMW_IST(n)) from the lambda actual values (LAM_IST(n))s (LAM_IST(n)); and calculating a difference (LAM_DIF(n)) between a lambda command value (LAM_SOLL(n)) being predetermined as a function of a load of the engine, and a mean lambda value (LAMMW_IST(n)), as an input variable of the lambda controller.

In accordance with yet another mode of the invention, there is provided a method which comprises choosing a control amplification factor (LAM_KPI_FAK) as a function of an idle time (LAM_TOTZ) being determined by a fuel prestorage duration, a duration of an intake, compression, working and expulsion stroke and a gas transit time for a particular oxygen sensor, from a performance graph as a function of load and rpm.

In accordance with a concomitant mode of the invention, there is provided a method which comprises limiting a value of a controller output variable (LAM) and the integral controller component (LAM_I) of the lambda controller to ±25% of a basic injection signal (TI_B).

In order to control the mean value of the air number, a linear proportional-integral-differential controller (PID controller) is used. The controlled system can be replicated with sufficient accuracy through the use of an idle time element and two first order delay elements. With the aid of this system model, a controller structure can be constructed having parameters which are dependent on the idle time of the lambda control loop, the time constants of the delay elements, and the rpm. Since these system variables are easily ascertained by measurements, the expense for the application of the lambda controller can be reduced substantially.

Other features which are considered as characteristic for the invention are set forth in the appended claims.

Although the invention is illustrated and described herein as embodied in a method for parametrizing a linear lambda controller for an internal combustion engine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
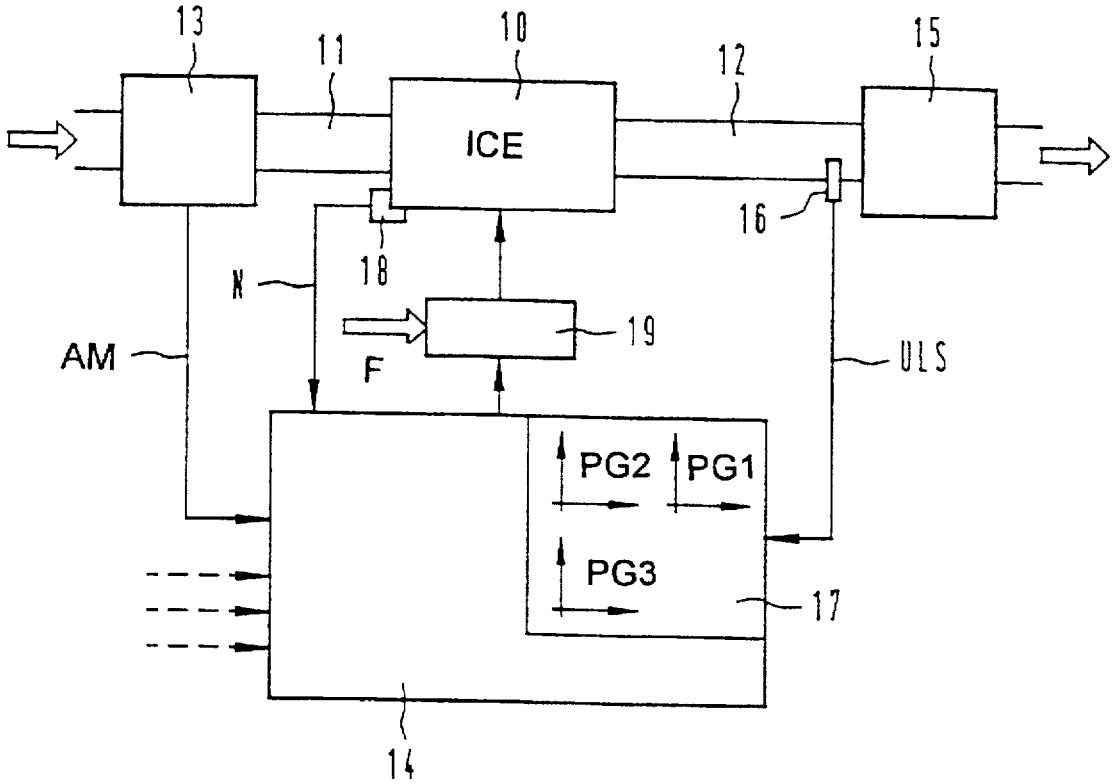
FIG. 1 is a block circuit diagram of a lambda control device for an internal combustion engine.

Referring now to the figures of the drawings in detail and first, particularly, to FIG. 1 thereof, there is seen a block circuit diagram in simplified form, in which only those elements that are necessary to comprehension of the invention are shown.

Reference numeral 10 indicates an internal combustion engine ICE with an intake line 11 and an exhaust line 12. An air flow rate meter 13 disposed in the intake line 11 measures the mass of air aspirated by the engine 10 and outputs a corresponding signal AM to an electronic control unit 14. The air flow rate meter 13 may be constructed as a hot-wire or hot-film air flow rate meter.

A linear lambda sensor 16 is inserted in the exhaust line 12, upstream of a three-way catalytic converter 15 serving to convert HC, CO and $NO_x$ components of exhaust gas from the engine 10. The linear lambda sensor 16 outputs an output signal ULS as a function of a residual oxygen content in the exhaust gas and supplies it to a lambda control device 17 for evaluation and conversion of this signal. The lambda control device 17 is preferably integrated with the electronic control unit or lambda controller 14 of the engine 10. Such electronic control units for engines, which handle not only fuel injection and ignition control but also many other tasks in controlling the engine, are known per se, so that only its layout that relates to the present invention and its mode of operation are discussed below.

The heart of the electronic control unit 14 is a microcomputer, which controls the requisite functions in accordance with a fixed program. In this kind of air flow rate-guided control of the engine, a basic injection time TI_B is calculated with the aid of the signal AM furnished by the air flow rate meter 13 and a signal N furnished by an rpm or speed sensor 18 and is processed in appropriate circuits. The basic injection time is then corrected with the aid of the lambda control device and as a function of further operating parameters, such as the pressure and temperature of the aspirated air, the temperature of the coolant, and so forth. In FIG. 1, the signals required therefor are suggested in dashed lines as input variables for the electronic control unit 14.

Through the use of the lambda control, outside certain special engine operating states that require a rich or lean mixture composition, a fuel-air mixture is established that meets the stoichiometric ratio ($\lambda$=1). A fuel F is metered to the aspirated air with the aid of one or more injection valves 19.

Figure 2:
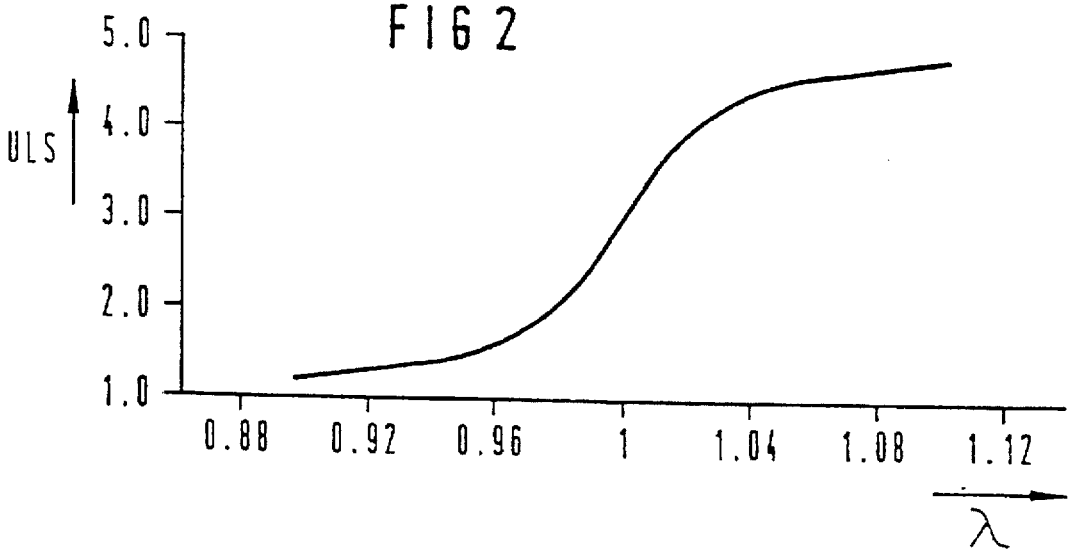
FIG. 2 is a diagram of a relationship between a sensor signal and an air number of a linear lambda sensor.

In FIG. 2, the dependency of the sensor output signal ULS of a linear lambda sensor on the air number $\lambda$ is shown. In a narrow range from $0.97<\lambda<1.03$, a virtually linear relationship between the sensor signal ULS and the air number $\lambda$ results. In the rich and lean air number range, the sensor characteristic curve exhibits a saturation behavior. The sensor signal is converted into a lambda actual value LAM_IST through the use of a characteristic curve or one-dimensional performance graph PG1 stored in memory.

A proportional, integral and differential (PID) controller is used as the lambda controller.

The transfer function of the lambda controlled system can be represented by the series connection of two first-order delay elements and one idle time element.

A first order delay element results from the response behavior of the lambda sensor, which is described by a time constant T_SONDE.

A further first order delay element results from sliding averaging of the lambda measurement values, having a behavior over time which is described by a time constant T_GMW.

An idle time T_TOTZ in the lambda control loop is composed of a fuel prestorage duration, a duration of the intake, compression, work and expulsion strokes, and a gas travel time of the exhaust gas.

The following relationship thus results for a transfer function of the controlled system $G_S(s)$:

$$G_S(s)=\frac{1}{T_SONDE\cdot s+1}\cdot\frac{1}{T_GMW\cdot SH}\cdot e^{-T_TOTZ\cdot s}$$

The values for T_SONDE, T_GMW and T_TOTZ are variables that can be obtained by computer or by measurement. If the controller transmission function $G_R(s)$ is set as $$G_R(s)=K_R\cdot\frac{(T_{R1}\cdot s+1)\cdot(T_{R2}\cdot s+1)}{s}$$

where $K_R$=controller amplification $T_{R1}$, $T_{R2}$=time constant of the controller, and if one selects $T_{R1}$=T_SONDE, and $T_{R2}$=T_GMW, then the poles of the controlled system are compensated for.

Figure 3:
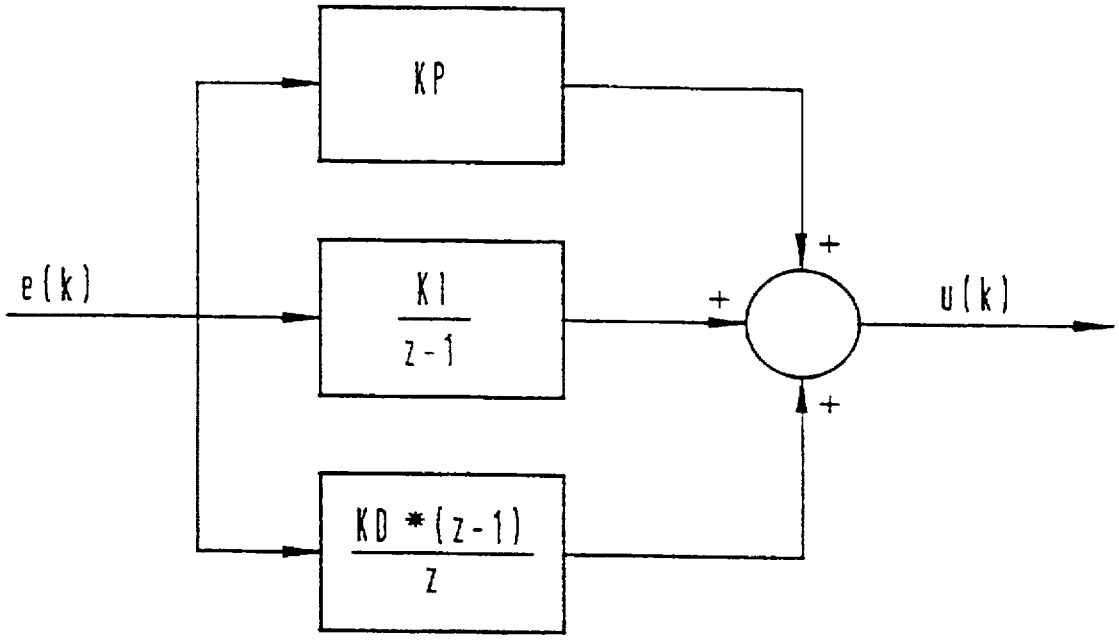
FIG. 3 is a block circuit diagram of a controller structure.

In the case of the parameters of an equivalent discrete proportional-integral-differential control algorithm, of the kind shown in FIG. 3, the following relationship results for the P, I and D components:

$$KP=(T_SONDE+T_GMW+TA/2)\cdot K$$

$$K1=TA\cdot K$$

$$KD=(T_SONDE\cdot T_GMW\cdot 1/TA)\cdot K$$

In general, e(k) designates the controller deviation as an input variable, and u(k) designates the manipulated variable as an output variable. In the case of lambda control, the input variable e(k)=LAM_DIF, and the output variable u(k)=TI_LAM, or in other words the intervention into the injection time calculation.

The ratio of the P, I and D components is accordingly determined by the system variables T_Sonde, T_GMW and TA. As the sole variable remaining to be determined by application, there is the factor K, which is to be chosen as a function of the idle time.

The described method is equally usable for a PI controller, and the calculation of the controller parameters will now be explained in terms of such a PI controller.

The proportional component LAM_P and the integration component LAM_I are calculated as a function of the mean lambda value LAMMW_IST and the command value LAM_SOLL. The command value LAM_SOLL is stored in a performance graph PG2 as a function of the load, for instance the air flow rate AM and the rpm N of the engine.

In order to calculate the mean lambda value LAMMW_IST(n), a predeterminable number of lambda measured values LAM_IST, for instance six measured values per cycle, corresponding to two crankshaft rotations, are detected and stored in memory:

LAM_IST_i

| n-6 | n-5 | n-4 | n-3 | n-2 | n-1 |
|---|---|---|---|---|---|
| | | | | | |

where:

n=number of the measured value

LAM_SUM(n)=LAM_SUM(n−1)−LAM_IST(n−6)+LAM_IST(n)

LAMMW_IST(n)=LAM_SUM_(n)/6

The input variable for the lambda controller is the control deviation LAM_DIF_(n), which is defined as the difference between the command value LAM_SOLL(n), taken from the performance graph PG2 in a load-dependent manner, and the mean lambda value LAMMW_IST(n):

LAM_DIF_=LAM_SOLL(n)−LAMMW_IST(n)

The lambda controller components LAM_P and LAM_I of the lambda controller are calculated as follows:

LAM_P_(n)=LAM_KPI_FAK(n) * P_FAK_LAM * (T_LS+TA) * LAM_DIF_(n)

LAM_I(n)=LAM_I_(n−1)+LAM_KPI_FAK(n) * I_FAK_LAM * 2 * TA * LAM_DIF_(n)

where:

LAM_KPI_FAK=control amplification factor

P_FAK_LAM=applicable constant

I_FAK_LAM=applicable constant

T_LS=applicable time constant

TA=sampling time

The choice of the control amplification factor LAM_KPI_FAK is made as a function of an idle time LAM_TOTZ in the lambda control loop, which is composed of the fuel prestorage duration, the duration of the intake, compression, working and expulsion stroke and the gas transit time for the particular lambda sensor. This idle time LAM_TOTZ is taken from the performance graph PG3 as a function of load and rpm.

The influence of the lambda controller is found as the sum of the controller components LAM_P and LAM_I:

LAM(n)=LAM_P(n)+LAM_I(n)

This value of the controller output is preferably limited to ±25% of the basic injection time, that is −0.25<LAM(n)<0.25. The integral component may additionally be limited to ±25% of the basic injection time, that is −0.25<LAM_I(n)<0.25.

This is intended to prevent the injection time from being variable beyond a certain extent by way of the lambda control.

Necessary variations in the injection time that are required, for instance, because of a defect, are then achieved by varying other parameters.

The output variable of the lambda controller is taken into account in the calculation of the injection time TI:

TI=TI_B * . . . (1+TI_LAM)

We claim:

1. A method for parametrizing a lambda controller of a lambda control device having a lambda sensor supplying an output signal at least partially exhibiting a linear dependency on an oxygen content in exhaust gas of an internal combustion engine, which comprises:

defining a response behavior of a lambda sensor as a first first order delay;

subjecting an output signal of the lambda sensor to sliding averaging and defining the sliding averaging of the measured lambda values as a second first order delay;

representing a transfer function of a lambda controlled system by a series connection of the first and second first order delays and an idle time in a lambda control loop, for obtaining a lambda control signal; and adjusting an air fuel ratio of an air fuel mixture supplied to the internal combustion engine in response to the lambda control signal.

2. The method according to claim 1, which comprises:

selecting a proportional-integral-differential (PID) controller as the lambda controller, and determining P, I and D controller components of the controller according to:

$$KP=T_SONDE+T_GMW+TA/2)\cdot K$$

$$K1=TA\cdot K$$

$$KD=(T_SONDE\cdot T_GMW\cdot 1/TA)\cdot K$$

where:

T_SONDE is a time constant for the response performance of the lambda sensor,

T_GMW is a time constant for sliding averaging,

T_TOTZ is an idle time in the lambda control loop,

TA is a sampling time, and

K is a factor.

3. The method according to claim 1, which comprises selecting a proportional-integral (PI) controller as the lambda controller, and calculating P and I controller components of the controller as a function of a mean lambda value (LAMMW_IST) and a command value (LAM_SOLL).

4. The method according to claim 3, which comprises:

determining the proportional controller component as:

LAM_P_(n)=LAM_KPI_FAK(n)·P_FAK_LAM·(T_LS+TA)·LAM_DIF(n), and determining the integral controller component as:

LAM_I(n)=LAM_I(n−1)+LAM_KPI_FAK(n)·I_FAK_LAM·2·TA·LAM_DIF(n)

where:

LAM_KPI_FAK=control amplification factor,

P_FAK_LAM=applicable constant,

I_FAK_LAM=applicable constant,

T_LS=applicable time constant,

TA=segment duration, n=number of the measured value, and

LAM_DIF(n)=control deviation.

5. The method according to claim 1, which comprises:

sampling the sensor signal (ULS1) multiple times per cycle of the engine;

ascertaining an associated lambda actual value (LAM_IST(n)) from a characteristic curve for each value of the sensor signal (ULS1, ULS2);

forming a mean lambda value (LAMMW_IST(n)) from the lambda actual values (LAM_IST(n))s (LAM_IST(n)); and calculating a difference (LAM_DIF(n)) between a lambda command value (LAM_SOLL(n)) being predetermined as a function of a load of the engine, and a mean lambda value (LAMMW_IST(n)), as an input variable of the lambda controller.

6. The method according to claim 5, which comprises choosing a control amplification factor (LAM_KPI_FAK) as a function of an idle time (LAM_TOTZ) being determined by a fuel prestorage duration, a duration of an intake, compression, working and expulsion stroke and a gas transit time for a particular oxygen sensor, from a performance graph as a function of load and rpm.

7. The method according to claim 6, which comprises limiting a value of a controller output variable (LAM) and the integral controller component (LAM_I) of the lambda controller to ±25% of a basic injection signal (TI_B).

8. A method of adjusting a fuel-air ratio of a fuel-air mixture supplied to an internal combustion engine, which comprises:

supplying to a lambda controller of a lambda control device of an internal combustion engine, with a lambda sensor exposed to exhaust gas of an internal combustion engine, an output signal which exhibits at least partially a linear dependency on an oxygen content in the exhaust gas;

parametrizing the lambda controller by representing a transfer function of a lambda controlled system with a first delay followed in series by a second delay and by an idle time component in a lambda control loop, wherein the first delay represents a response behavior of the lambda sensor; and the second delay represents a sliding averaging of measured lambda values;

adjusting an air fuel ratio of an air fuel mixture supplied to the internal combustion engine with the parametrized lambda controller.

* * * * *